US010858147B2

(12) United States Patent
Kozarsky et al.

(10) Patent No.: US 10,858,147 B2
(45) Date of Patent: Dec. 8, 2020

(54) ENHANCEMENT FOR PACKAGE WITH PLASTIC HEADER

(71) Applicant: ILLINOIS TOOL WORKS INC., Glenview, IL (US)

(72) Inventors: Neil J. Kozarsky, Mount Laurel, NJ (US); Stephen P. Belko, Blackwood, NJ (US); John A. Caporaso, Moorestown, NJ (US); Frank J. Kelly, Glen Ellyn, IL (US); Robert E. Hogan, Burr Ridge, IL (US); Eric Plourde, Frankfort, IL (US); Kenny E. McCracken, Dacula, GA (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 237 days.

(21) Appl. No.: 13/761,716

(22) Filed: Feb. 7, 2013

(65) Prior Publication Data

US 2013/0277367 A1 Oct. 24, 2013

Related U.S. Application Data

(60) Provisional application No. 61/637,430, filed on Apr. 24, 2012.

(51) Int. Cl.

| | |
|---|---|
| ***B65D 6/16*** | (2006.01) |
| ***B65D 8/00*** | (2006.01) |
| ***B65D 5/74*** | (2006.01) |
| ***B65D 5/72*** | (2006.01) |

(52) U.S. Cl.

CPC ..... *B65D 15/00* (2013.01); *B65D 5/72* (2013.01); *B65D 5/746* (2013.01)

(58) Field of Classification Search

CPC ..... B65F 1/1615; B65D 43/162; B65D 33/24; B65D 33/1683; F16J 13/08; A47K 11/02; B60N 3/103; B60N 3/108

USPC ..... 383/120

See application file for complete search history.

(56) References Cited

U.S. PATENT DOCUMENTS

| | | | | |
|---|---|---|---|---|
| 2,093,977 | A * | 9/1937 | Farmer | B65D 65/10 383/14 |
| 4,082,216 | A | 4/1978 | Clarke | |
| D276,502 | S | 11/1984 | Imamura | |
| 4,691,373 | A | 9/1987 | Ausnit | |
| D303,500 | S | 9/1989 | Colla | |
| D312,208 | S | 11/1990 | Sorkin | |
| D365,022 | S | 12/1995 | Wada | |
| 5,788,378 | A | 8/1998 | Thomas | |
| D425,410 | S | 5/2000 | Berman | |
| 6,063,416 | A | 5/2000 | Teasdale | |
| 6,110,512 | A | 8/2000 | Teasdale | |
| D433,625 | S | 11/2000 | Berman | |
| 6,234,676 | B1 | 5/2001 | Galomb et al. | |
| D451,794 | S | 12/2001 | Ichikawa | |
| D471,437 | S | 3/2003 | Ichikawa | |
| D473,462 | S | 4/2003 | Green et al. | |
| D482,966 | S | 12/2003 | Booth et al. | |
| D486,731 | S | 2/2004 | Meeker et al. | |

(Continued)

FOREIGN PATENT DOCUMENTS

| | | |
|---|---|---|
| JP | 2002104511 | 4/2002 |

*Primary Examiner* — Stephen J Castellano

(74) *Attorney, Agent, or Firm* — McCarter & English, LLP

(57) ABSTRACT

Various embodiments of the container of the type with a semi-rigid or rigid container portion and reclosable header are provided.

9 Claims, 8 Drawing Sheets

(56) References Cited

U.S. PATENT DOCUMENTS

| | | | | |
|---|---|---|---|---|
| 6,854,888 | B1 * | 2/2005 | Brown | A45F 3/20 222/107 |
| 6,908,422 | B2 | 6/2005 | Ichikawa | |
| D523,743 | S | 6/2006 | Solowiejko et al. | |
| 7,160,029 | B2 | 1/2007 | Bein | |
| 7,207,716 | B2 | 4/2007 | Buchanan | |
| D581,262 | S | 11/2008 | Suyama et al. | |
| D582,263 | S | 12/2008 | Smith et al. | |
| 7,524,111 | B1 | 4/2009 | Williams | |
| D597,854 | S | 8/2009 | Berman | |
| 7,611,284 | B2 | 11/2009 | Borchardt et al. | |
| D624,817 | S | 10/2010 | Fisher et al. | |
| D633,809 | S | 3/2011 | Bradley | |
| D634,646 | S | 3/2011 | Belko et al. | |
| 7,976,220 | B2 * | 7/2011 | Brauer | B65D 31/10 383/120 |
| D643,716 | S | 8/2011 | Kozarsky et al. | |
| 8,210,746 | B2 | 7/2012 | Kerr et al. | |
| D670,941 | S | 11/2012 | Vernon | |
| 2,945,053 | A1 | 3/2013 | McCracken et al. | |
| D679,881 | S | 4/2013 | Colayco et al. | |
| D682,683 | S | 5/2013 | Brogan et al. | |
| D700,064 | S | 2/2014 | Berman | |
| D700,066 | S | 2/2014 | Berman | |
| 8,690,046 | B2 * | 4/2014 | Plourde | B65D 33/24 229/125.015 |
| 2004/0066983 | A1 * | 4/2004 | Hogan et al. | 383/64 |
| 2005/0053315 | A1 | 3/2005 | Aasen | |
| 2005/0194386 | A1 | 9/2005 | Shai | |
| 2011/0017812 | A1 | 1/2011 | Belko | |
| 2011/0017814 | A1 * | 1/2011 | Belko | B65D 5/563 229/124 |
| 2011/0297680 | A1 | 12/2011 | Howell | |
| 2011/0301006 | A1 | 12/2011 | Howell | |
| 2012/0060449 | A1 | 3/2012 | Howell | |
| 2012/0187182 | A1 | 7/2012 | Howell | |

* cited by examiner

ENHANCEMENT FOR PACKAGE WITH PLASTIC HEADER

This application claims priority under 35 U.S.C. §119(e) of U.S. provisional patent application Ser. No. 61/637,430 filed on Apr. 24, 2012, the contents of which is hereby incorporated by reference in its entirety.

BACKGROUND OF THE DISCLOSURE

1. Field of the Disclosure

The present disclosure relates to enhancements for packages, wherein the packages include a semi-rigid or rigid container portion and a plastic header portion which is typically reclosable.

2. Description of the Prior Art

In the prior art, the use of a plastic flexible header and reclosure in combination with a semi-rigid or rigid box structure is a developing field. The container, as well as the machinery and method for the production thereof, is disclosed in U.S. patent application publications 2011/0297680 A1; 2011/0301006 A1; 2012/0060449 A1; and 2012/0187182 A1, all entitled "Carton with Plastic Reclosable Header" and based upon applications filed on Sep. 14, 2010, the disclosures of all of which are hereby incorporated by reference in their entirety. These applications are commonly owned with the present application. Somewhat similar disclosures are found in U.S. patent application publication 2011/0017814 A1 entitled "Combined Box and Resealable Bag" based upon an application filed on Jul. 23, 2009 and patent application publication 2011/0017812 A1 entitled "Combined Box and Resealable Bag" based on an application originally filed on Jan. 5, 2010. While the container, as well as the machinery and method of production thereof, has been found to be satisfactory and well-adapted to its intended purposes, further improvements are sought, particularly with regard to convenience, sustainability and performance.

Previous embodiments in this field include those disclosed in U.S. Pat. No. 7,524,111 entitled "Rigid-Bottomed Resealable Bag with Handles", issued on Apr. 28, 2009 to Williams; U.S. Pat. No. 7,207,716 entitled "Flexible Container Having Flat Walls", issued on Apr. 24, 2007 to Buchanan; U.S. Pat. No. 7,160,029 entitled "Enclosure for Resealing a Package and Method Therefor", issued on Jan. 9, 2007 to Bein; U.S. Pat. No. 6,908,422 entitled "Reclosable Packaging Bag and Method for Manufacturing Same", issued on Jun. 21, 2005 to Ichikawa et al.; U.S. Pat. No. 6,110,512 entitled "Package and Merchandiser", issued on Aug. 29, 2000 to Teasdale; U.S. Pat. No. 6,063,416 entitled "Procedure and Package to Enable Peg Display of Food Pouch in Tent-Style Paperboard Carton", issued on May 16, 2000 to Teasdale et al.; U.S. Pat. No. 4,691,373 entitled "Zipper Closure with Unitary Adhesive Cover Sheet", issued on Sep. 1, 1987 to Ausnit; and U.S. Published Patent Application No. 2005/0194386, entitled "Zipper Box Covers" published on Sep. 8, 2005 for Shai; and Japanese Patent No. 2002104511 entitled "Bag-in-Carton", published on Apr. 10, 2002 for Makoto et al.

OBJECTS AND SUMMARY OF THE DISCLOSURE

It is therefore an object of the present disclosure to provide improvements to a reclosable package which has rigid walls thereby providing a high capacity, space-efficient package with a flat printing surface thereby providing protection for the packaging of crushable or delicate products.

It is therefore a further object of the present disclosure to provide improvements to a package which is light in weight and which is typically reclosable.

These and other objects are attained by the present disclosure by providing various improvements to a package which includes a rigid or semi-rigid carton-type container and, attached thereto, a plastic, polymer, or similar flexible header, typically with a reclosable zipper configuration, but not limited thereto.

BRIEF DESCRIPTION OF THE DRAWINGS

Further objects and advantages of the disclosure will become apparent from the following description and from the accompanying drawings, wherein.

DETAILED DESCRIPTION OF THE PREFERRED EMBODIMENTS

Figure 1:
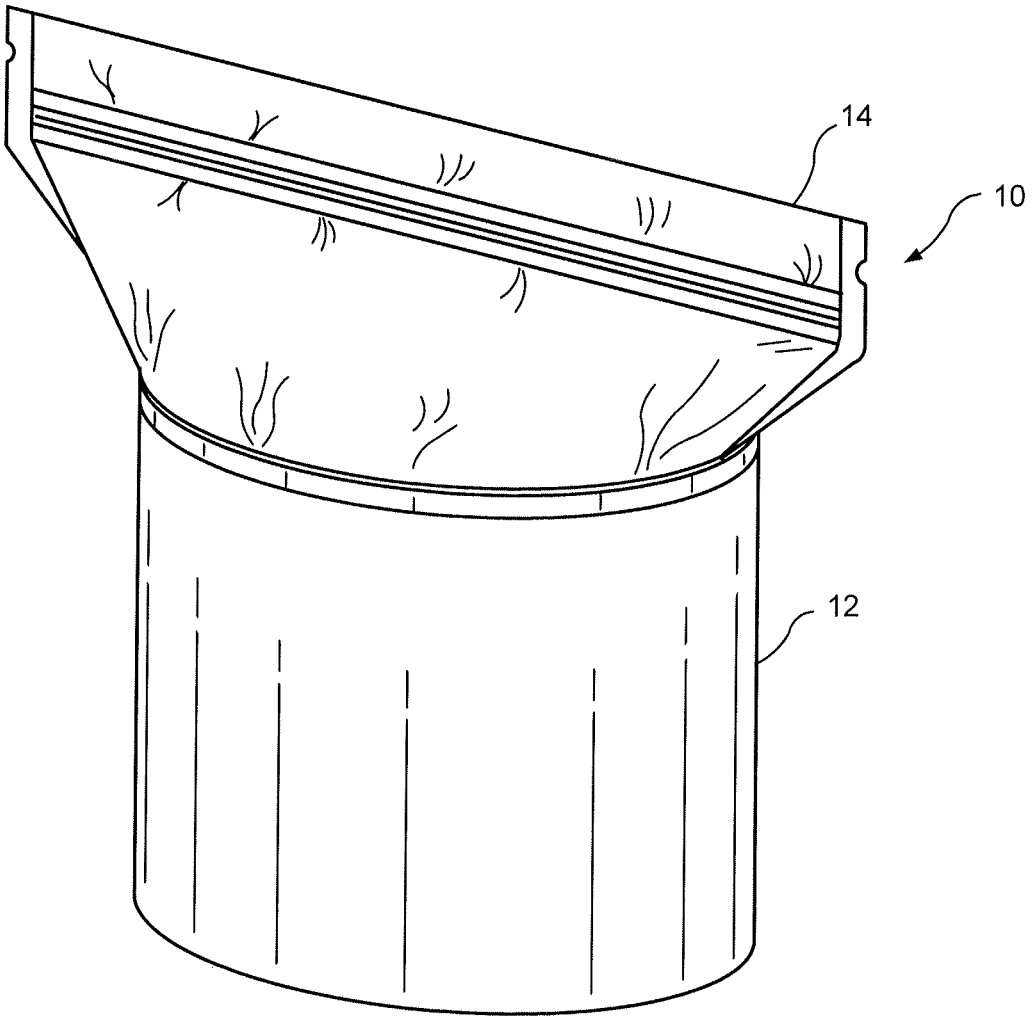
FIG. 1 is a perspective view of a first embodiment of the present disclosure.

Referring now to the drawings in detail wherein like numerals indicate like elements throughout the several views, one sees that FIG. 1 is a perspective view of the first embodiment of the package 10 of the present disclosure. Package 10 includes a semi-rigid or rigid container portion 12 and a plastic or polymer reclosable header 14. The typical materials of the container portion 12 and the reclosable header 14 are described in the commonly-owned prior art listed above. However, the prior art typically included a container portion with a square or rectangular opening or mouth for receiving the header 14. However, in the embodiment of FIG. 1, the semi-rigid or rigid container portion 12 has a circular shape, as viewed from above, thereby forming a circular mouth for receiving the reclosable header 14. Other possible envisioned shapes include oval-shaped, hexagonal, orthogonal and triangular.

Figure 2:
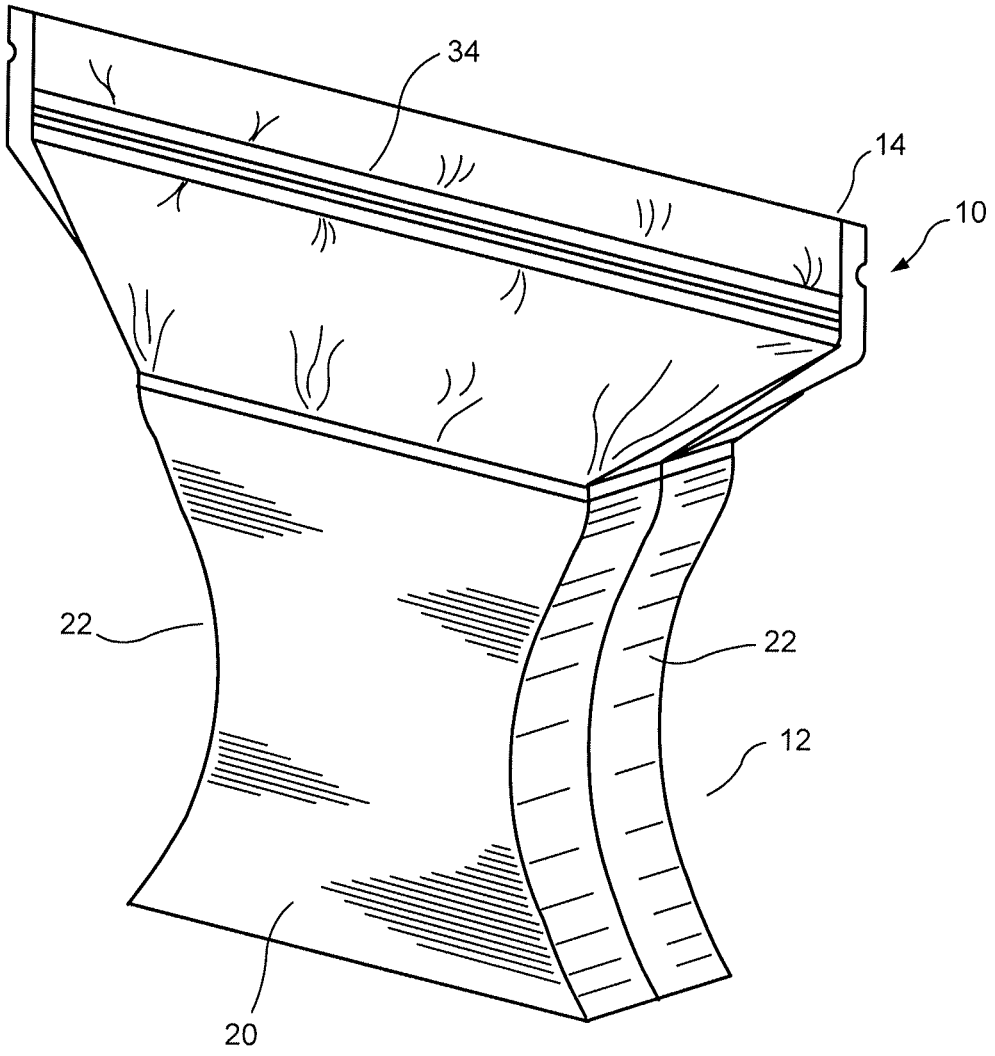
FIG. 2 is a perspective view of a second embodiment of the present disclosure.

In the embodiment illustrated in FIG. 2, the semi-rigid or rigid container portion 12 includes front wall 20, rear wall (not illustrated), corresponding to the rear front wall 20, and side walls 22. While the commonly-owned prior art discloses containers with planar walls which are frequently substantially or nearly orthogonal with each other, FIG. 2 discloses the front wall 20, as well as unillustrated corresponding co-extensive rear wall, with an hourglass shape formed by inwardly concave side edges and arcuate side walls 22 which follow the inwardly concave side edges of front wall 20. A rectangular mouth is presented for receiving the polymer reclosable header 14, which includes reclosure 34, which may be, but is not limited to, a zipper. It is envisioned that most, if not all, of the zippers discussed in the commonly-owned prior art would be applicable to this embodiment.

Figure 3:
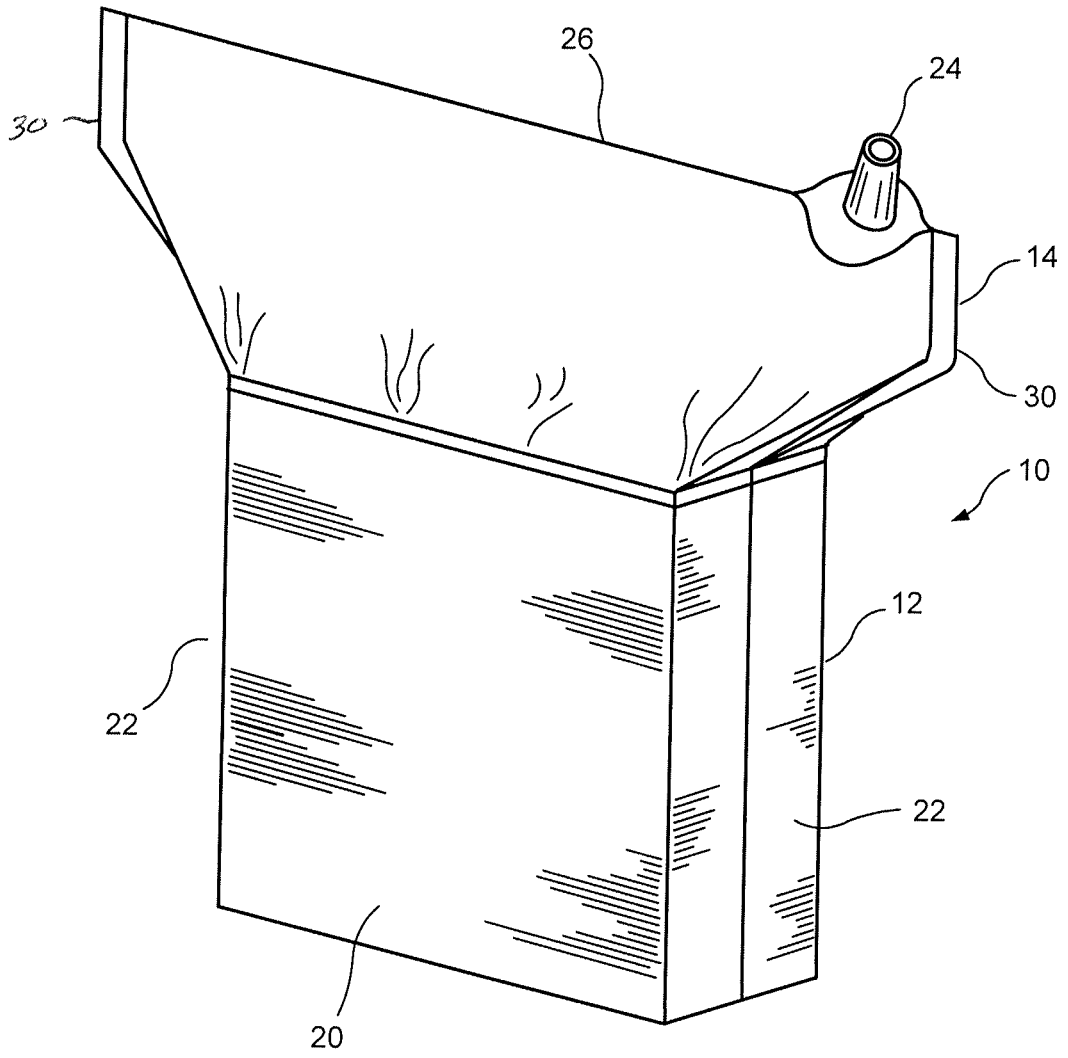
FIG. 3 is a perspective view of a third embodiment of the present disclosure.

In the embodiment illustrated in FIG. 3, the semi-rigid or rigid container portion 12 is presented with a rectangular or orthogonal shape. However, the reclosable header 14 has a fitment 24 inserted with the top fold or top seam 26 in order to provide a pour spout for liquid, granular or similar contents of the package 10. Alternatively, the fitment 24 may be inserted into an upper portion of one of the side seams 30 of the reclosable header 14. The semi-rigid or rigid container 12 is envisioned to be the same or substantially the same as those disclosed in the commonly-owned application or other embodiments disclosed herein.

Figure 4:
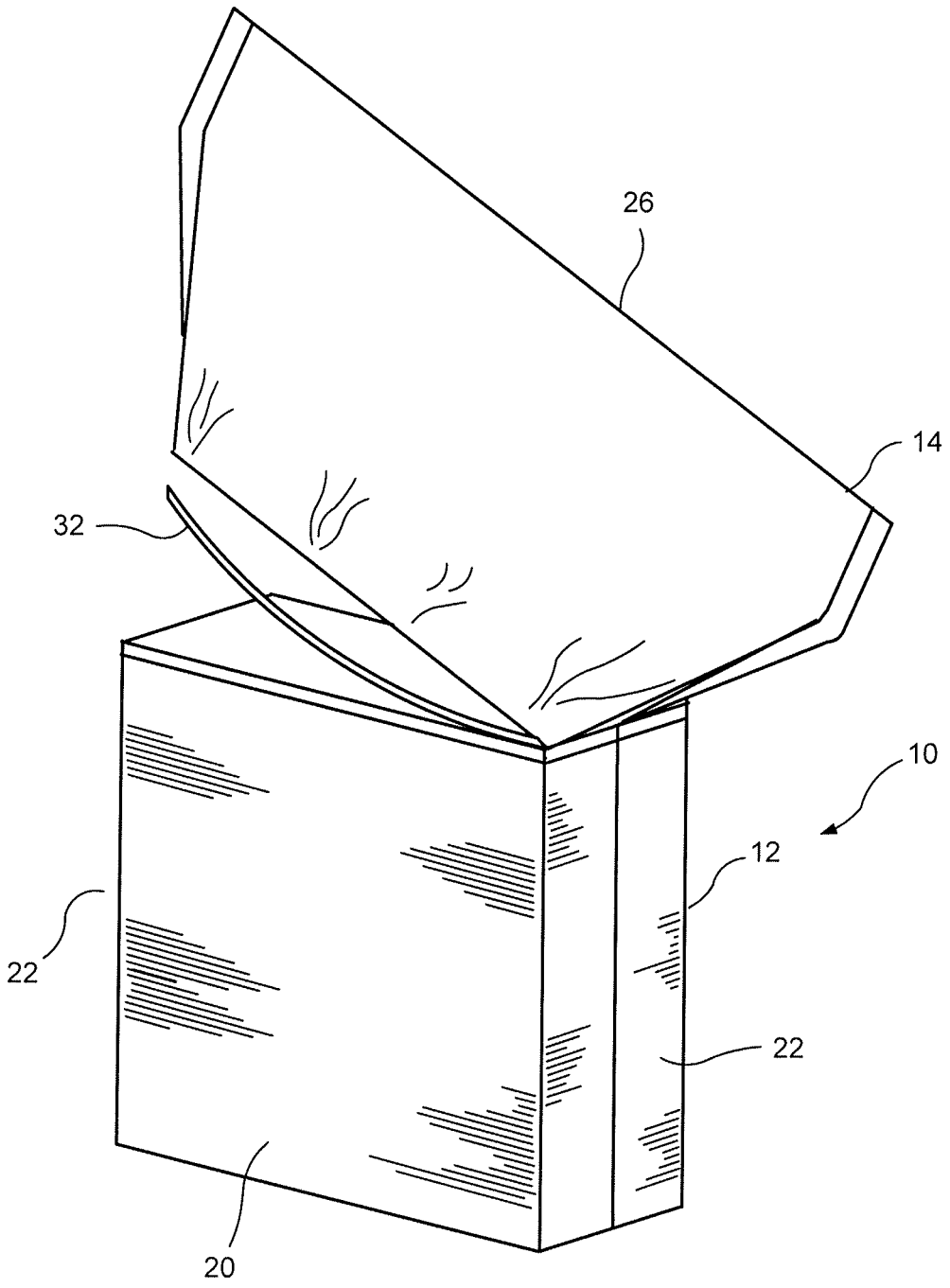
FIG. 4 is a perspective view of a fourth embodiment of the present disclosure.

In the embodiment illustrated in FIG. 4, the reclosable header 14 is releasably attached to the semi-rigid or rigid container portion 12 by a tear tape 32 or similar attachment device such as, but not limited to, a peelable seal (rather than a typical adhesive, heat sealing, or similar method). Similarly, a score line or line of weakness could be provided in the reclosable header 14, near the area of joinder with respect to the semi-rigid or rigid container portion. This use of tear tape 32 or similar attachment device allows the user to remove the reclosable header 14 from the semi-rigid or rigid container 12 after consumer use in order to facilitate recycling. Other than for the method of attachment between the header 14 and the semi-rigid or rigid container portion 12, it is envisioned that the header 14 and semi-rigid or rigid container portion 12 are typically the same or substantially the same as those disclosed in the commonly-owned prior art or the other embodiments disclosed herein.

Figure 5:
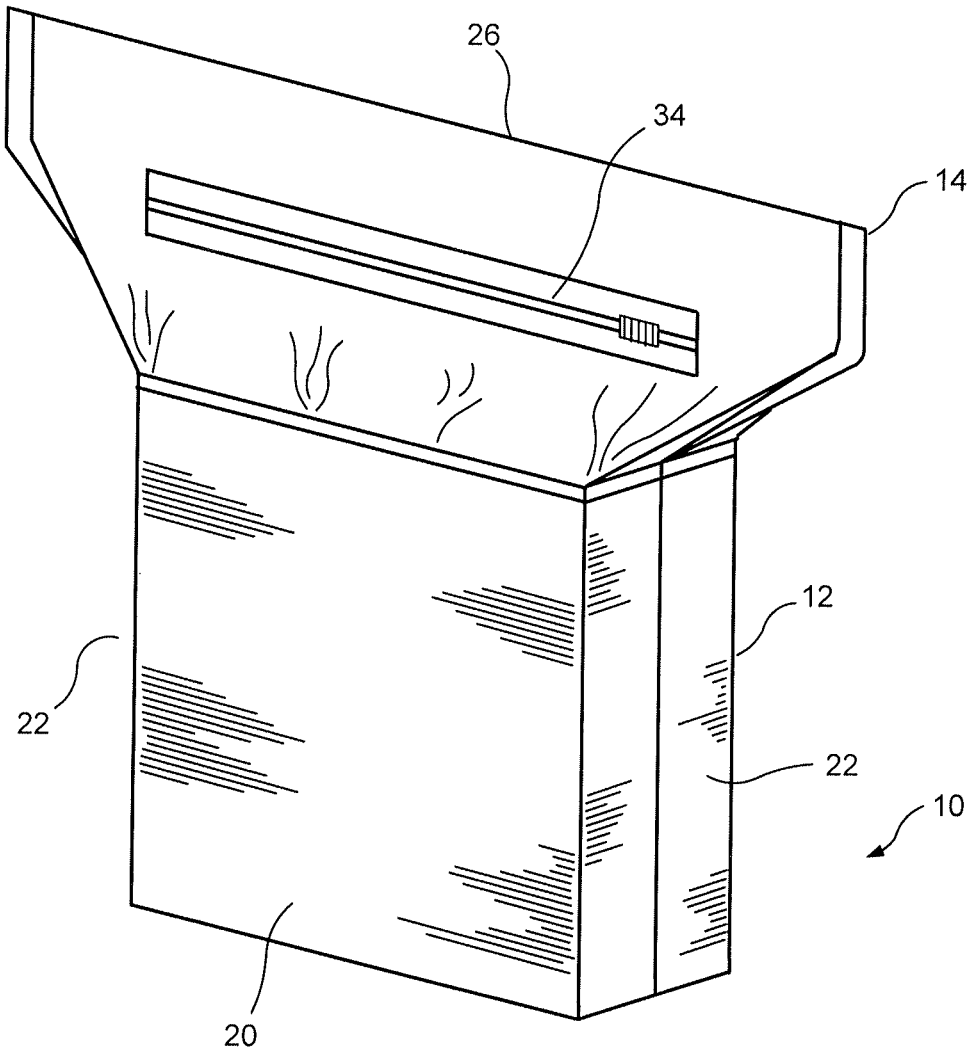
FIG. 5 is a perspective view of a fifth embodiment of the present disclosure.
Figure 6A:
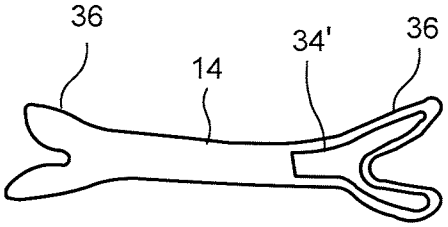
FIG. 6A is a cross-sectional view of a gusseted embodiment of the present disclosure.
Figure 6B:
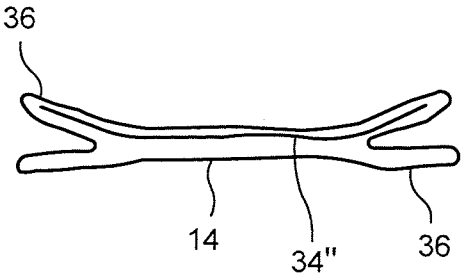
FIG. 6B is a cross-sectional view of an alternative gusseted embodiment of the present disclosure.
Figure 6C:
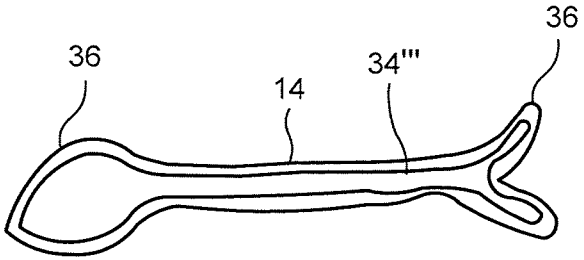
FIG. 6C is a cross-sectional view of a further alternative gusseted embodiment of the present disclosure.
Figure 6:
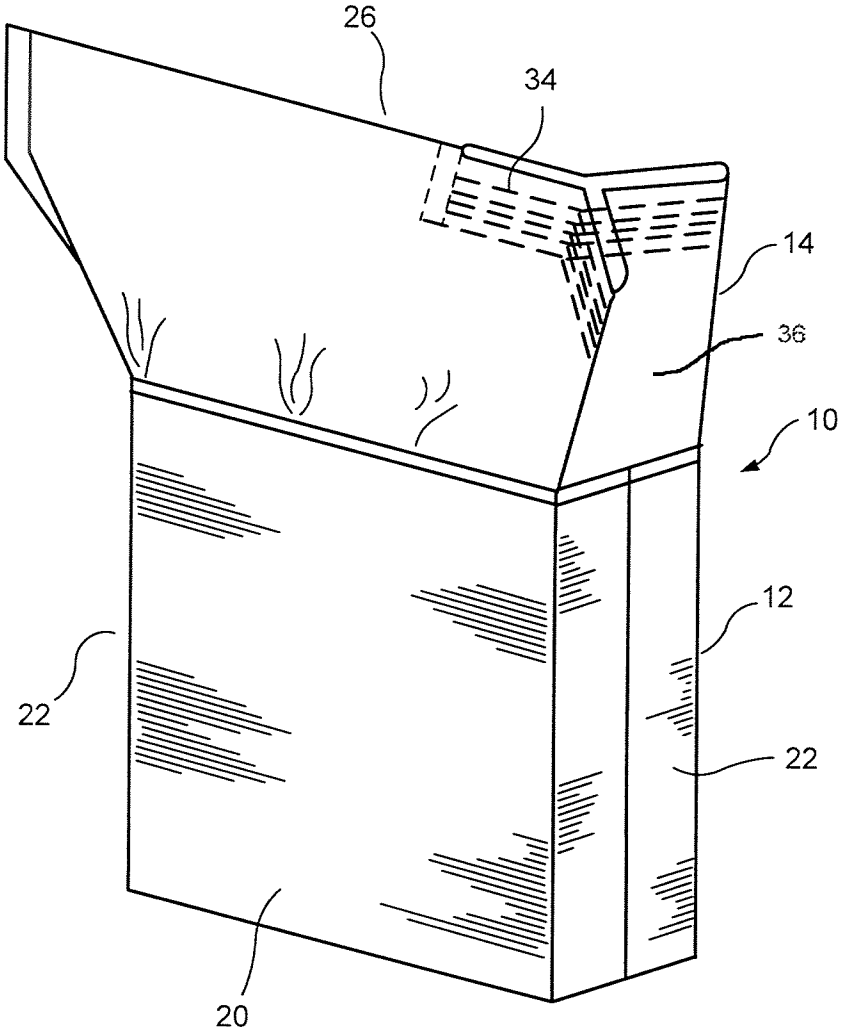
FIG. 6 is a perspective view of a sixth embodiment of the present disclosure.

In the embodiment illustrated in FIG. 5, the reclosable header 14, rather than including a reclosure on the top fold or top seam 26, the zipper or reclosure 34 is provided on a front panel of the reclosable header 14. The zipper or reclosure 34 may have many configurations, including, but not limited to, being attached to the inside or outside of the front panel, and may be a slider zipper, a press-to-close zipper, or many other possible zipper configurations. There are many advantages to this type of zipper application because the zipper can be applied prior to the film being folded, segments of the zipper can be applied in lieu of a continuous strip of zipper, etc. The semi-rigid or rigid container 12 is envisioned to be the same or substantially the same as those disclosed in the commonly-owned application or other embodiments disclosed herein.

in the embodiment illustrated in FIG. 6, one of the edges or side seals of the reclosable header 14 is replaced with a gusset 36. The gusset 36 forms a wall closing the opening left by a gap between a front wall and a back wall of the reclosable header 14, While FIG. 6 illustrates a single gusset 36, it is envisioned that this embodiment may include a gusset on each side of the reclosable header 14. The top edges of the right end portion of the top seam 26 include top edges of the front wall and back wall and a top edge of the gusset 36. These top edges forming a Y-configuration with two arms when the top seam 36 and reclosure 34 are placed in a closed configuration as shown at the right side of FIG. 6. The top edge of the gusset partially forming the two arms may be folded outwardly or opened to provide a pour spout (see the left hand side of FIG. 6C), This opens the top seam 26 and reclosure 34, The pour spout may be very convenient for flakey or grainy products, such as, but not limited to, cereal or similar food products. In such a configuration, the zipper of reclosure 34 may be partially attached to the header 14. A further advantage of the gusset 36 is that it provides a more upright posture and less overhang, compare gusseted construction on the right side of Fig, 6 with the prior design shown on the left side of Fig, 6. FIG. 6A is across -sectional top view showing how a single gusset 36 can have a dedicated zipper or reclosure 34'. FIG. 6B is a cross-sectional top view of a zipper or reclosure 34" extending along a length of the front or the rear of the interior of the reclosable header 14. FIG. 6C is a cross-sectional top view of zipper or reclosure 34" extending around the entire internal periphery of the reclosable header 14, The semi-rigid or rigid container 12 is envisioned to be the same or substantially the same as those disclosed in the commonly-owned application or other embodiments disclosed herein.

Figure 7:
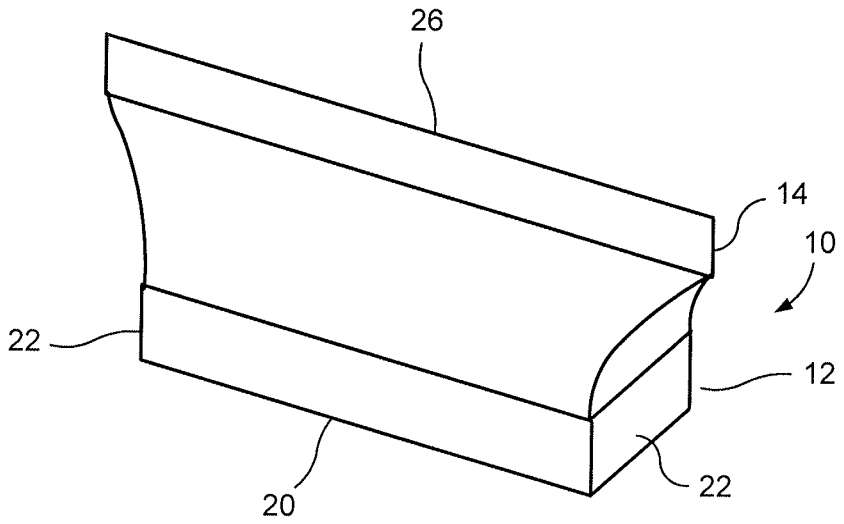
FIG. 7 is a perspective view of a seventh embodiment of the present disclosure.

In the embodiment illustrated in FIG. 7, the semi-rigid or rigid container portion 12 is substantially shallower (i.e., of reduced height) than the containers of the prior art, thereby creating a tray-like configuration. Other than for the height of the semi-rigid or rigid container portion 12, it is envisioned that the header 14 and semi-rigid or rigid container portion 12 are typically the same or substantially the same as those disclosed in the commonly-owned prior art or the other embodiments disclosed herein.

Figure 8:
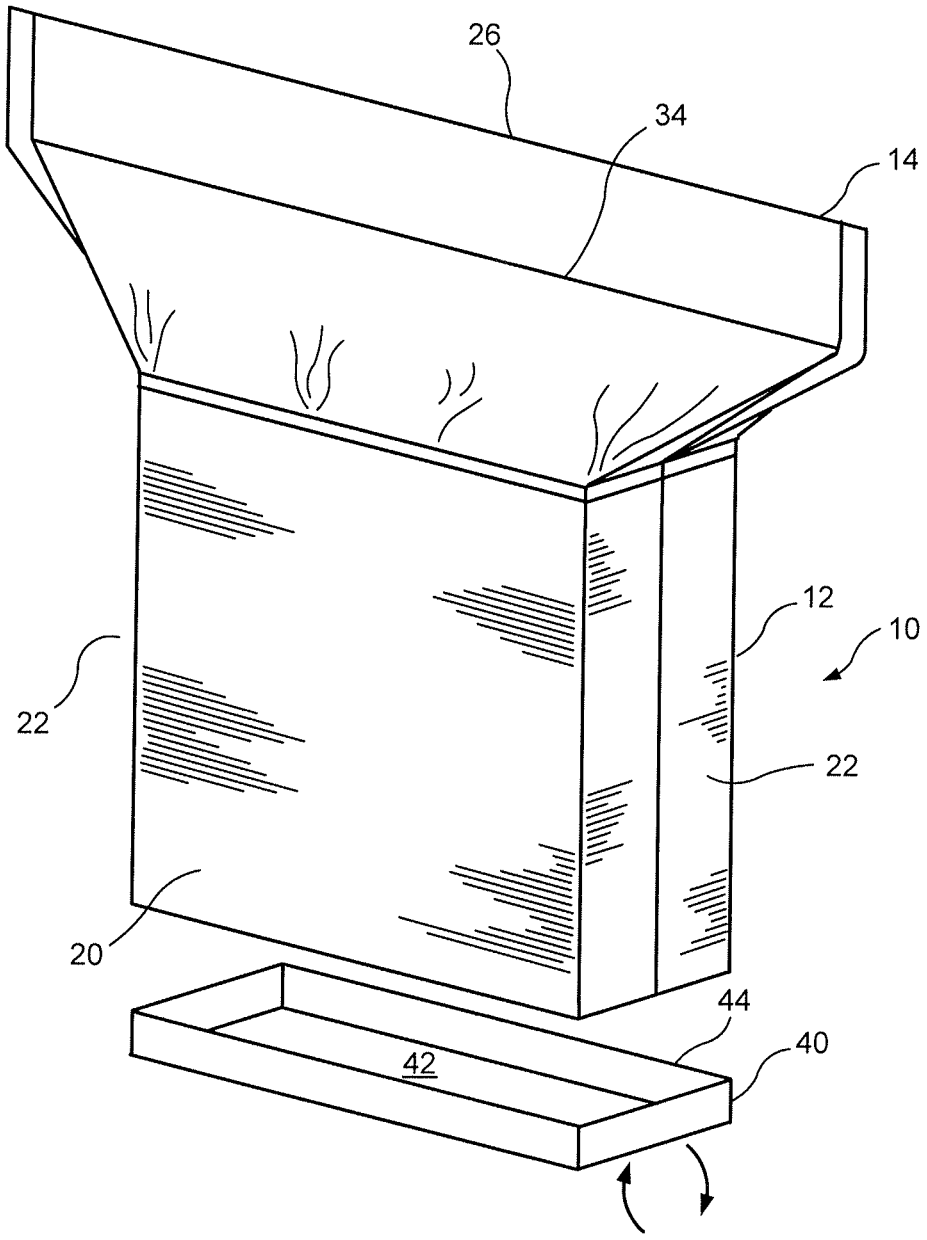
FIG. 8 is a perspective view of an eighth embodiment of the present disclosure.

In the embodiment illustrated in FIG. 8, the bottom of the semi-rigid or rigid container portion 12 is provided by tray-like plug 40, which may be attached or disattached from the semi-rigid or rigid container portion 12. Tray-like plug 40 is typically made from material similar to that of the semi-rigid or rigid container portion 12, and likewise may be coated with heat sealable material for heat sealing to the semi-rigid or rigid container portion 12. Tray-like plug 40 includes a planar lower floor 42 which serves as the bottom of the semi-rigid or rigid container portion 12. The planar lower floor 42 is typically rectangular in order to correspond to the open bottom of the semi-rigid or rigid container portion 12. Of course, different shapes of the open bottom would likewise typically require a corresponding shape of the planar lower floor 42. Tray-like plug 40 further includes sidewalls 44 extending upwardly (or perpendicularly) about the periphery of lower floor 42. The plug 40 could slide up into the base of the semi-rigid or rigid container portion 12 so that the sidewalls 44 are inside of the semi-rigid or rigid container portion 12 (that is, adhesive on the outside of sidewalls 44 would contact the interior of semi-rigid or rigid container portion 12). Alternatively, the base of the semi-rigid or rigid container portion could fit inside of the sidewalls 44 (that, is adhesive on the inside of sidewalls 44 would contact the exterior of semi-rigid or rigid container portion 12). Of course, heat sealing may be substituted for the adhesive joining. A mandrel may be used to assist in the sealing of the semi-rigid or rigid container portion 12 to the plug 40. These configurations could also be used in fill from the bottom embodiments. That is, semi-rigid or rigid container portion 12 would be inverted with an open bottom facing upwardly (with header 14 attached and closed, facing downwardly), the package 10 would be filled with product through this open bottom and then the tray-like plug 40 would be glued or otherwise secured to the semi-rigid or rigid container portion 12 thereby sealing the package 10. Other than for the construction of the bottom of the semi-rigid or rigid container portion 12, it is envisioned that the header 14 and semi-rigid or rigid container portion 12 are typically the same or substantially the same as those disclosed in the commonly-owned prior art or the other embodiments disclosed herein.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A package including:

a container portion formed from a rigid or semi-rigid material, the container portion including a side wall structure, a bottom and an open top;

a flexible header including a first header wall and a second header wall of flexible polymeric material different from the rigid or semi-rigid material, and at least one inwardly-folding gusset at an end of the flexible header, positioned between the first header wall and the second header wall, the at least one inwardly-folding gusset on an upper portion of the header and including first and second opposed flexible polymeric gusset walls in an inwardly-folding V-shaped configuration attached to each other above the container portion, the at least one gusset and the first and second header walls defining a spout in an open configuration and a Y-configuration in a closed configuration, the first and second header walls fastened to an upper portion of the rigid or semirigid container portion, whereby the at least one inwardly-folding gusset terminates at the upper portion of the rigid or semi-rigid container portion thereby providing communication between the rigid or semi-rigid container portion and spout, and at least a portion of upper edges of the first and second header walls of the flexible header being attached by a fold or seam to each other above the top of the container portion, thereby covering the open top of the container portion and providing a closed package for contents therewithin, the header including a Y-shaped reclosure, conforming to the Y-configuration in the closed configuration, separate from the fold or seam, with a first portion attached to an interior of the first header wall and a second portion attached to an interior of the second header wall for providing reclosable access to the container portion between the first and second header walls.

2. The package of claim 1 wherein the reclosure extends only around the at least one gusset.

3. The package of claim 1 wherein the header includes a front wall and a rear wall and wherein the reclosure extends along substantially all of a first of the front wall and the rear wall and only a portion of the second of the front wall and the rear wall.

4. The package of claim 1 wherein the reclosure extends around an entire internal periphery of the package.

5. A package including:

a container portion formed from a rigid or semi-rigid material, the container portion including a side wall structure, a bottom and an open top;

a flexible header including first and second header walls of flexible polymeric material different from the rigid or semi-rigid material, a first inwardly-folding gusset and a second inwardly-folding gusset at respective first and second ends of the flexible header positioned between the first and second header walls, the first inwardly-folding gusset and the second inwardly-extending gusset each on an upper portion of the header and including first and second opposed flexible polymeric gusset walls in an inwardly-folding V-shaped configuration attached to each other above the container portion, the first and second gussets, in combination with the first and second header walls, defining respective first and second spouts in an open configuration and a Y-configuration in a closed configuration, the first and second header walls fastened to an upper portion of the rigid or semi-rigid container portion, whereby the first and second inwardly-folding gussets terminate at the upper portion of the rigid or semi-rigid container portion thereby providing communication between the rigid or semi-rigid container portion and the first and second spouts, and at least a portion of upper edges of the first and second header walls of the flexible header being attached by a fold or seam to each other above the top of the container portion, thereby covering the open top of the container portion and providing a closed package for contents therewithin, the header including a reclosure, with at least one Y-shaped portion conforming to at least one of the Y-configurations in the closed configuration, separate from the fold or seam, with a first portion attached to an interior of the first header wall and a second portion attached to an interior of the second header wall for providing reclosable access between the first and second walls.

6. The package of claim 5 wherein the reclosure extends only around the first gusset.

7. The package of claim 5 wherein the header includes a front wall and a rear wall and wherein the reclosure extends along substantially all of a first of the front wall and the rear wall and only a portion of the second of the front wall and the rear wall.

8. The package of claim 5 wherein the reclosure extends around an entire internal periphery of the package.

9. The package of claim 5 wherein the first gusset in formed on a first end of the header and the second gusset is formed on a second end of the header.

* * * * *